US011339460B2

(12) United States Patent
Jung et al.

(10) Patent No.: US 11,339,460 B2
(45) Date of Patent: May 24, 2022

(54) FERRITIC STAINLESS STEEL HAVING EXCELLENT HIGH-TEMPERATURE OXIDATION RESISTANCE, AND MANUFACTURING METHOD THEREFOR

(71) Applicant: POSCO, Pohang-si (KR)

(72) Inventors: Il Chan Jung, Pohang-si (KR); Jin-Suk Kim, Pohang-si (KR); Han-Hyuk Go, Pohang-si (KR); Ji Eon Park, Pohang-si (KR)

(73) Assignee: POSCO, Pohang-si (KR)

( * ) Notice: Subject to any disclaimer, the term of this patent is extended or adjusted under 35 U.S.C. 154(b) by 50 days.

(21) Appl. No.: 16/771,469

(22) PCT Filed: Sep. 6, 2018

(86) PCT No.: PCT/KR2018/010399
§ 371 (c)(1),
(2) Date: Jun. 10, 2020

(87) PCT Pub. No.: WO2019/117430
PCT Pub. Date: Jun. 20, 2019

(65) Prior Publication Data

US 2021/0087660 A1 Mar. 25, 2021

(30) Foreign Application Priority Data

Dec. 11, 2017 (KR) ..... 10-2017-0169079

(51) Int. Cl.
*C22C 38/28* (2006.01)
*C22C 38/20* (2006.01)
(Continued)

(52) U.S. Cl.
CPC ..... *C22C 38/28* (2013.01); *C21D 6/002* (2013.01); *C21D 6/005* (2013.01); *C21D 6/008* (2013.01);
(Continued)

(58) Field of Classification Search
CPC ..... C22C 38/28; C22C 38/00; C22C 38/004; C22C 38/001; C22C 38/002; C22C 38/02;
(Continued)

(56) References Cited

U.S. PATENT DOCUMENTS

2005/0211348 A1* 9/2005 Miyazaki ..... C22C 38/04 148/609
2006/0225820 A1 10/2006 Hamada et al.

FOREIGN PATENT DOCUMENTS

CN 101845603 A 9/2010
EP 0593776 A1 4/1994
(Continued)

OTHER PUBLICATIONS

Machine Translation, Ishikawa et al., JP 2012-177157 A, Sep. 2012. (Year: 2012).*
(Continued)

*Primary Examiner* — Michael E. La Villa
(74) *Attorney, Agent, or Firm* — Morgan, Lewis & Bockius LLP

(57) ABSTRACT

Disclosed are a ferritic stainless steel capable of inhibiting high temperature oxidation through generation of an effective oxide scale, and manufacturing method thereof. The ferritic stainless steel excellent in oxidation resistance at high temperature according to an embodiment of the present disclosure includes, in percent (%) by weight of the entire composition, Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities, and satisfies a following equation (1).

$$W/(Ti+Al) \geq 10 \quad (1)$$

12 Claims, 5 Drawing Sheets

(51) Int. Cl.

| | |
|---|---|
| ***C22C 38/26*** | (2006.01) |
| ***C22C 38/22*** | (2006.01) |
| ***C22C 38/02*** | (2006.01) |
| ***C22C 38/04*** | (2006.01) |
| ***C22C 38/00*** | (2006.01) |
| ***C22C 38/06*** | (2006.01) |
| ***C21D 8/02*** | (2006.01) |
| ***C21D 9/00*** | (2006.01) |
| ***C21D 9/46*** | (2006.01) |
| ***C21D 6/02*** | (2006.01) |
| ***C21D 6/00*** | (2006.01) |
| ***C22C 38/12*** | (2006.01) |
| ***C22C 38/14*** | (2006.01) |
| ***C22C 38/42*** | (2006.01) |
| ***C21D 8/00*** | (2006.01) |
| ***C22C 38/18*** | (2006.01) |
| ***C22C 38/44*** | (2006.01) |
| ***C22C 38/50*** | (2006.01) |
| ***C22C 38/16*** | (2006.01) |
| ***C22C 38/48*** | (2006.01) |

(52) U.S. Cl.

CPC ..... *C21D 6/02* (2013.01); *C21D 8/005* (2013.01); *C21D 8/0205* (2013.01); *C21D 8/0226* (2013.01); *C21D 8/0236* (2013.01); *C21D 8/0247* (2013.01); *C21D 8/0273* (2013.01); *C21D 8/0278* (2013.01); *C21D 8/0284* (2013.01); *C21D 9/0081* (2013.01); *C21D 9/46* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/26* (2013.01); *C22C 38/42* (2013.01); *C22C 38/44* (2013.01); *C22C 38/48* (2013.01); *C22C 38/50* (2013.01); *C21D 2211/004* (2013.01); *C21D 2211/005* (2013.01); *Y10T 428/1259* (2015.01); *Y10T 428/1266* (2015.01); *Y10T 428/12583* (2015.01); *Y10T 428/12597* (2015.01); *Y10T 428/12604* (2015.01); *Y10T 428/12611* (2015.01); *Y10T 428/12618* (2015.01); *Y10T 428/12667* (2015.01); *Y10T 428/12951* (2015.01); *Y10T 428/12972* (2015.01); *Y10T 428/12979* (2015.01)

(58) Field of Classification Search

CPC ..... C22C 38/04; C22C 38/06; C22C 38/20; C22C 38/22; C22C 38/26; C22C 38/12; C22C 38/14; C22C 38/16; C22C 38/18; C22C 38/42; C22C 38/44; C22C 38/48; C22C 38/50; C21D 8/0247; C21D 8/0226; C21D 8/0236; C21D 8/005; C21D 8/0205; C21D 8/0278; C21D 8/0284; C21D 8/0273; C21D 6/02; C21D 6/002; C21D 6/005; C21D 6/008; C21D 9/46; C21D 9/0081; C21D 2211/004; C21D 2211/005; Y10T 428/12583; Y10T 428/1259; Y10T 428/12597; Y10T 428/12604; Y10T 428/12611; Y10T 428/12618; Y10T 428/1266; Y10T 428/12667; Y10T 428/12972; Y10T 428/12979; Y10T 428/12951

See application file for complete search history.

(56) References Cited

FOREIGN PATENT DOCUMENTS

| | | | | |
|---|---|---|---|---|
| EP | 2692889 | A1 | | 3/2012 |
| EP | 2692889 | A1 | | 2/2014 |
| JP | H09-118961 | A | | 5/1997 |
| JP | 2004-043949 | A | | 2/2004 |
| JP | 2007-254794 | A | | 10/2007 |
| JP | 2009-001834 | A | * | 1/2009 |
| JP | 2012-177157 | A | | 9/2012 |
| JP | 2014-177659 | A | | 9/2014 |
| KR | 10-2005-0007572 | A | | 1/2005 |
| KR | 10-2013-0107371 | A | | 10/2013 |
| KR | 10-2016-0076792 | A | | 7/2016 |
| WO | 2016/105065 | A1 | | 6/2016 |

OTHER PUBLICATIONS

Machine Translation, Kato, et al., JP 2009-001834 A, Jan. 2009. (Year: 2009).*

Extended European Search Report dated Jun. 18, 2020 issued in European Patent Application No. 18889591.6.

Chinese Office Action dated Mar. 29, 2021 issued in Chinese Patent Application No. 201880078027.9 (with English translation).

Written Opinion and International Search Report dated Jan. 10, 2019 issued in International Patent Application No. PCT/KR2018/010399 (English translation).

Japanese Notice of Reasons For Refusal dated Jun. 29, 2021 issued in Japanese Patent Application No. 2020-531641 (with English translation).

Korean Office Action dated Feb. 18, 2019 issued in Korean Patent Application No. 10-2017-0169079.

* cited by examiner

【FIGURE 1】
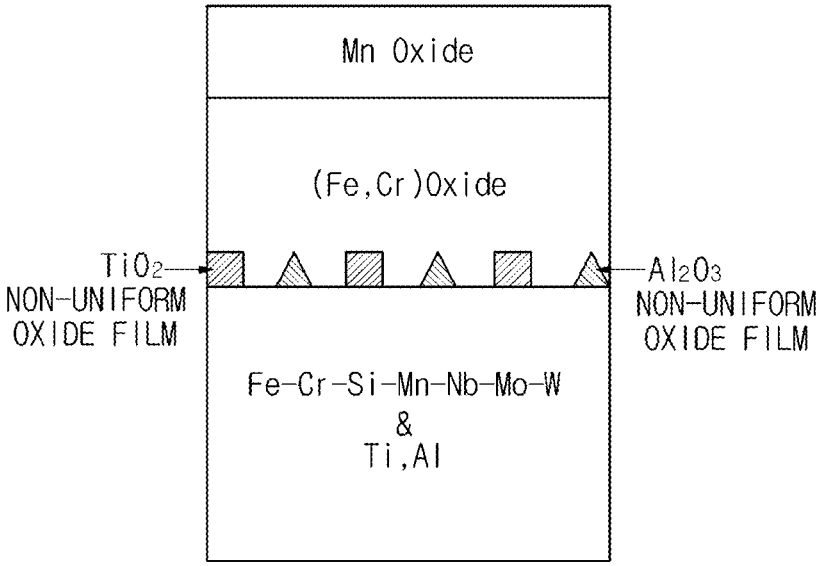

【FIGURE 2】
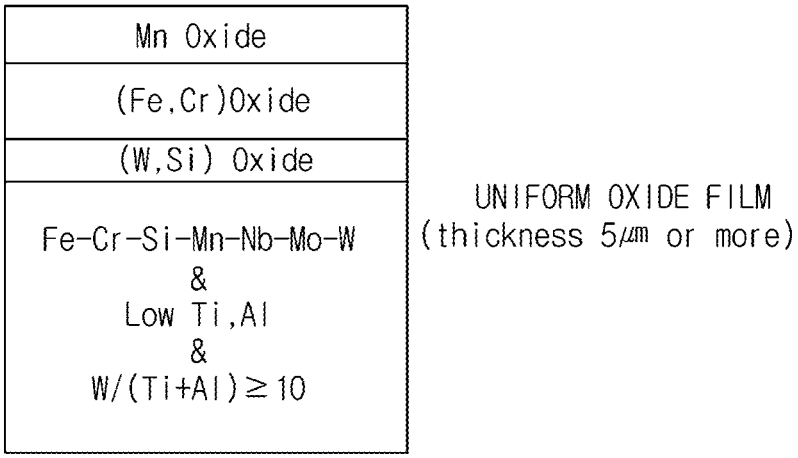

【FIGURE 3】
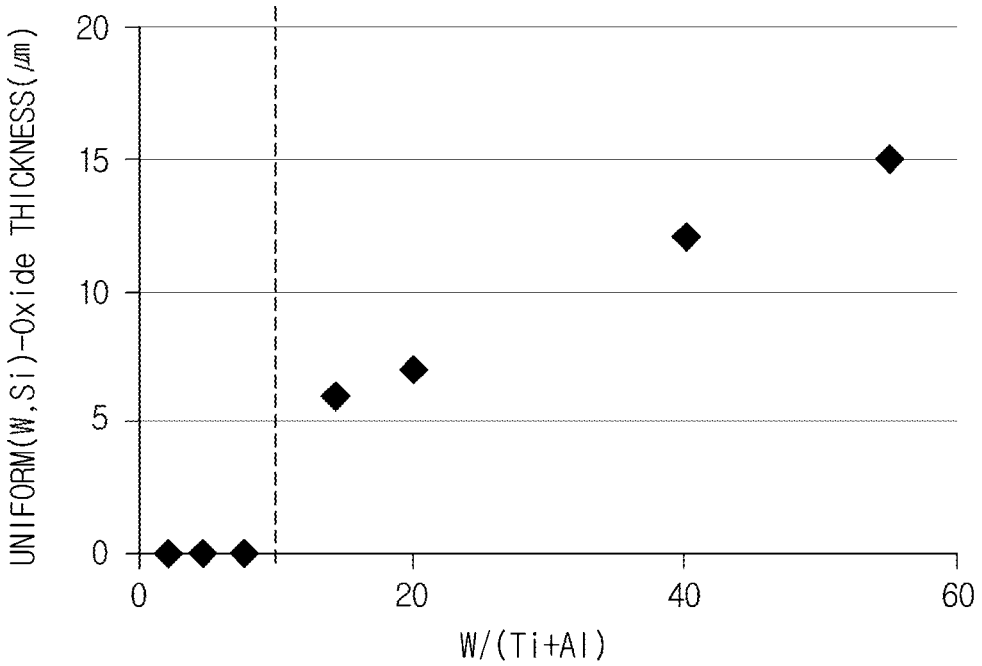

【FIGURE 4】
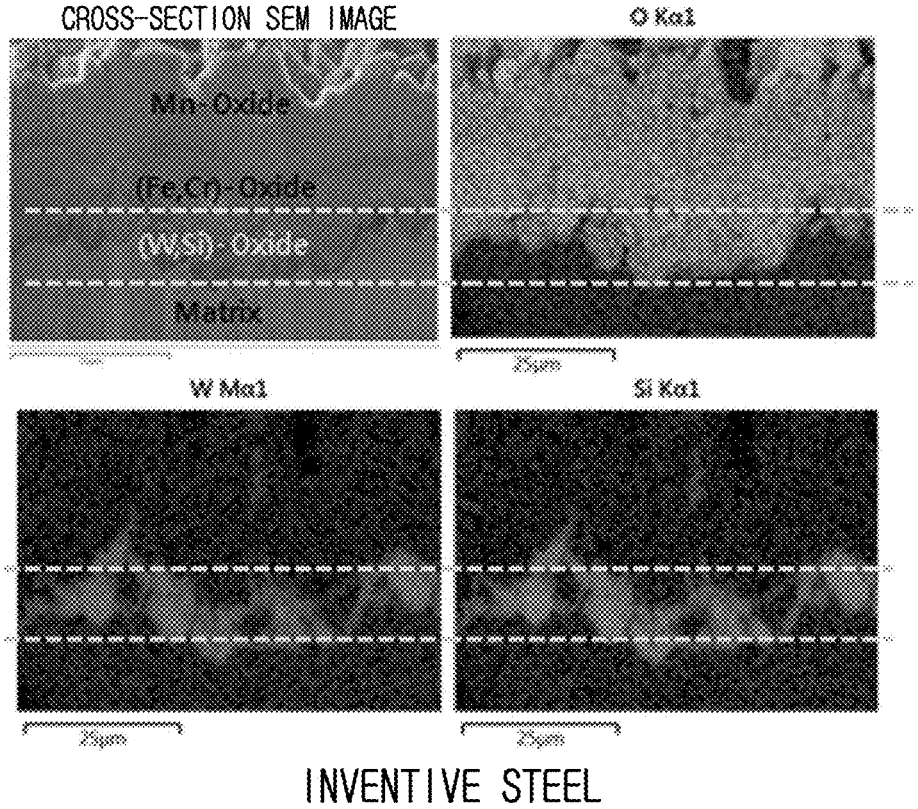
INVENTIVE STEEL

【FIGURE 5】
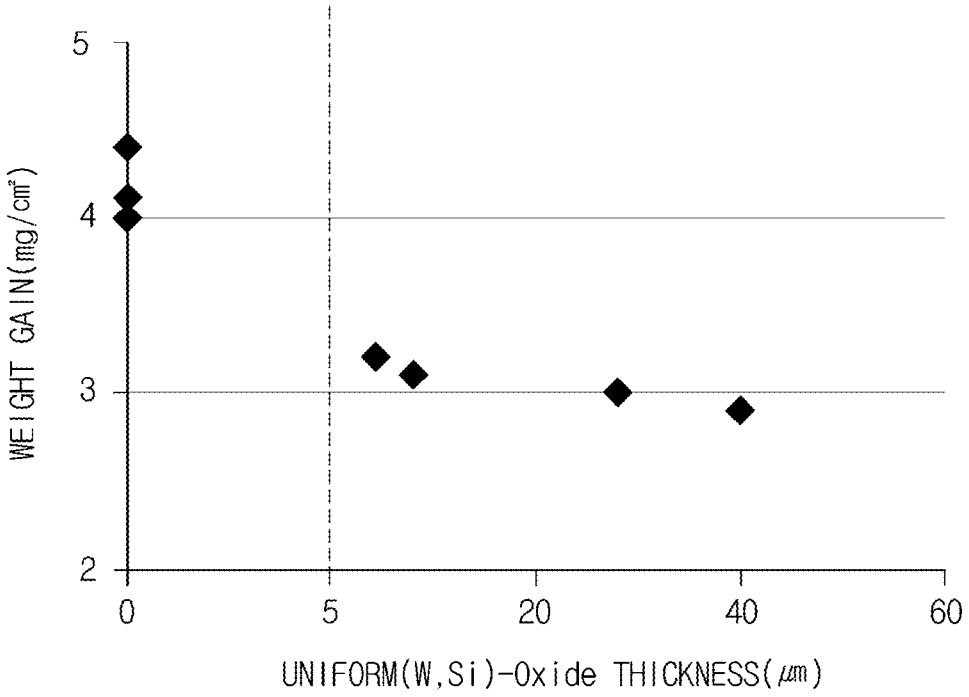

FERRITIC STAINLESS STEEL HAVING EXCELLENT HIGH-TEMPERATURE OXIDATION RESISTANCE, AND MANUFACTURING METHOD THEREFOR

CROSS-REFERENCE OF RELATED APPLICATIONS

This application is the U.S. National Phase under 35 U.S.C. § 371 of International Patent Application No. PCT/KR2018/010399, filed on Sep. 6, 2018, which in turn claims the benefit of Korean Application No. 10-2017-0169079, filed on Dec. 11, 2017, the entire disclosures of which applications are incorporated by reference herein.

TECHNICAL FIELD

The present disclosure relates to an optimal design method of ferritic stainless steel for preventing high temperature oxidation, and more particularly, to a ferritic stainless steel capable of inhibiting high temperature oxidation through the generation of an effective oxide scale and a manufacturing method thereof.

BACKGROUND ART

A Ferritic stainless steel is a steel with high price competitiveness compared to austenitic stainless steel because it has excellent corrosion resistance even with a small amount of expensive alloy elements added. Ferritic stainless steel is used for exhaust system parts (exhaust-manifold, collector cone) having an exhaust gas temperature of 800° C. or higher, but when exposed to high temperatures for a long time, high temperature oxidation occurs, resulting in deterioration in component durability.

In the past, product development has been made in terms of alloying components and manufacturing methods simply to increase high-temperature strength. However, studies on the oxidation scale of the stainless steel surface layer to suppress high temperature oxidation when exposed to high temperature environments for a long time in addition to increasing the high temperature strength have been insufficient.

DISCLOSURE

Technical Problem

Therefore, it is an aspect of the present disclosure to provide a ferritic stainless steel that may increase the durability of a component by suppressing high temperature oxidation when exposed to high temperature environments for a long time in addition to increasing the high temperature strength, and a manufacturing method thereof.

Technical Solution

In accordance with an aspect of the present disclosure, a ferritic stainless steel excellent in oxidation resistance at high temperature includes, in percent (%) by weight of the entire composition, Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities, and satisfies a following equation (1).

$$W/(Ti+Al) \geq 10 \quad (1)$$

(W, Ti, Al mean the content (% by weight) of each element).

The ferritic stainless steel may be exposed for 200 hours or more at 900° C. or higher, a [W,Si]-oxide film is formed on a surface layer.

The thickness of the [W, Si]-oxide film may be 5 μm or more.

The stainless steel may include 0.01 to 1.0% by weight of W Laves phase precipitate.

The stainless steel may further include C: 0.001 to 0.01%, N: 0.001 to 0.01%, Nb: 0.3 to 0.6%, Mo: 0.3 to 2.5% and Cu: 0.2% or less, and satisfies C+N: 0.018% or less.

The stainless steel may include 0.01 to 1.0% by weight of one or more of W Laves phase precipitate, Nb Laves phase precipitate and Mo Laves phase precipitate, and include 5% by weight of W based on 100% by weight of the Laves phase precipitate.

The W Laves phase precipitate may include any one or more selected from a group consisting of $Fe_2W$, FeCrW, $Cr_2W$.

The Nb Laves phase precipitate may include any one or more selected from a group consisting of $Fe_2Nb$, FeCrNb, $Cr_2Nb$.

The Mo Laves phase precipitate may include any one or more selected from a group consisting of $Fe_2Mo$, FeCrMo, $Cr_2Mo$.

The inevitable impurities may include any one or more of P: 0.05% or less, S: 0.005% or less, Mg: 0.0002 to 0.001%, and Ca: 0.0004 to 0.002%.

In accordance with an aspect of the present disclosure, a manufacturing method of a ferritic stainless steel excellent in oxidation resistance at high temperature, includes: aging a cold rolled annealing material comprising, in percent (%) by weight of the entire composition, Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities, and satisfying a following equation (1).

$$W/(Ti+Al) \geq 10 \quad (1)$$

(W, Ti, Al mean the content (% by weight) of each element).

The aging may be performed at 400 to 600° C. for 30 to 90 minutes.

The cold rolled annealing material may further include C: 0.001 to 0.01%, N: 0.001 to 0.01%, Nb: 0.3 to 0.6%, Mo: 0.3 to 2.5% and Cu: 0.2% or less, and satisfies C+N: 0.018% or less.

Advantageous Effects

In the ferritic stainless steel according to the embodiment of the present disclosure, after 200 hours or more exposure at 900° C. or more, the W and Si oxide films are uniformly formed, so that the high-temperature oxidation amount can be reduced by 20% or more, and thus the durability of the high-temperature exhaust system parts can be increased.

DESCRIPTION OF DRAWINGS

FIG. 1 is a schematic diagram of a behavior of forming an oxide scale when exposed to a high temperature for a long time when the W/(Ti+Al) value is less than 10.

FIG. 2 is a schematic diagram of the behavior of forming an oxide scale when exposed to high temperature for a long time when the W/(Ti+Al) value is 10 or more.

FIG. 3 is a graph illustrating the correlation of [W,Si]-Oxide thickness after 200 hours exposure at 900° C. according to W/(Ti+Al) value.

FIG. 4 is a Fe-SEM photograph illustrating the oxidation scale composition of the cross-section of the inventive steel after 200 hours exposure at 900° C.

FIG. 5 is a graph illustrating the correlation between the [W,Si]-Oxide thickness formed after 200 hours exposure at 900° C. and the weight gain due to oxidation.

BEST MODE

A ferritic stainless steel excellent in oxidation resistance at high temperature according to an embodiment of the present disclosure includes, in percent (%) by weight of the entire composition, Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities, and satisfies a following equation (1).

$$W/(Ti+Al) \geq 10 \quad (1)$$

(W, Ti, Al mean the content (% by weight) of each element)

Modes of the Invention

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Also, when a part "includes" or "comprises" an element, unless there is a particular description contrary thereto, the part may further include other elements, not excluding the other elements.

An expression used in the singular encompasses the expression of the plural, unless it has a clearly different meaning in the context.

The present disclosure defines the effective oxide scale composition for the suppression of high temperature oxidation for an optimal design method of ferritic stainless steel for preventing high temperature oxidation of parts for automobile exhaust systems, and presents a component and parameter for generating a target oxide scale.

A ferritic stainless steel excellent in oxidation resistance at high temperature according to an embodiment of the present disclosure includes, in percent (%) by weight of the entire composition, Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities, and satisfies a following equation (1).

$$W/(Ti+Al) \geq 10 \quad (1)$$

Hereinafter, the reason for the numerical limitation of the alloy component element content in the embodiment of the present disclosure will be described. In the following, unless otherwise specified, the unit is % by weight.

The content of Cr is 10% to 30%.

Chromium is an element effective for improving corrosion resistance of steels. In the present disclosure, Cr is added by 10% or more. However, when the Cr content is excessive, not only manufacturing costs increase but also grain boundary corrosion occurs, so that the Cr content is limited to 30% or less.

The content of Si is 0.2% to 1.0%.

Silicon is an element added for deoxidation of a molten steel during steelmaking and stabilization of ferrite. In the present disclosure, 0.2% or more of Si is added. However, when the content is excessive, the material is hardened and ductility of the steel is lowered, and thus the Si content is limited to 1.0% or less.

The content of Mn is 0.1% to 2.0%.

Manganese is an element effective for improving corrosion resistance. In the present disclosure, 0.1% or more is added, and more preferably 0.5% or more is added. However, when the Mn content is excessive, generation of Mn fumes will rapidly increase to deteriorate weldability and ductility of the steel is deteriorated due to formation of excessive MnS precipitates. The Mn content is limited to 2.0% or less, more preferably 1.5% or less.

The content of W is 0.3 to 2.5%.

Tungsten increases the corrosion resistance of ferritic stainless steel, improves high temperature strength, and increases high temperature sound absorption. Therefore, it is preferable to add 0.3% or more. However, when the content is excessive, brittleness occurs due to the formation of intermetallic precipitates. Therefore, it is preferable to limit the content to 2.5% or less.

The content of Ti is 0.001 to 0.15%.

Titanium fixes C and N to reduce the amount of solid solution C and solid solution N in steel and is effective in improving corrosion resistance of steel. However, the amount of Ti should be limited because Ti hinders the short range diffusion of W and Mo dissolved at a high temperature of 800° C. or higher and reduces high temperature sound absorption. However, in order to lower the Ti content to an extremely low level, since the additional steelmaking cost increases, the range is limited to 0.001 to 0.15%.

The content of Al is 0.001% to 0.1%.

Aluminum is a powerful deoxidizer, which serves to lower the content of oxygen in a molten steel, and is added in an amount of 0.001% or more in the present disclosure. However, when the Al content is excessive, the sleeve defect of the cold-rolled strip occurs due to the increase of non-metallic inclusions and weldability deteriorates. The Al content is limited to 0.1% or less.

When the above equation (1) is satisfied, diffusion of the surface layer portion of W and Si is activated, and when exposed at a temperature of 900° C. or higher for 200 hours or more, a W and Si oxide ([W,Si]-oxide) film may be formed on the surface of stainless steel. The [W,Si]-oxide film may be uniformly formed to a thickness of 5 μm or more. The [W,Si]-oxide film acts as a barrier to prevent the diffusion of Fe, Cr, and Mn in the base material, thereby suppressing further high-temperature oxidation.

FIG. 1 is a schematic diagram of a behavior of forming an oxide scale when exposed to a high temperature for a long time when the W/(Ti+Al) value is less than 10. FIG. 2 is a schematic diagram of the behavior of forming an oxide scale when exposed to high temperature for a long time when the W/(Ti+Al) value is 10 or more.

Generally, a Mn oxide film is formed on the outermost layer of the surface layer a ferritic stainless steel, and Fe and Cr oxide ([Fe,Cr]-oxide) film is formed between the base material and the Mn oxide film.

When the W/(Ti+Al) value is less than 10, in the Ti and Al contents according to the components of the present disclosure, a non-uniform $TiO_2$, $Al_2O_3$ oxide film is formed as shown in FIG. 1. Since it does not suppress the diffusion of Fe, Cr, Mn, and O, the amount of high temperature oxidation increases when exposed to high temperature for a long time. On the other hand, when the W/(Ti+Al) value is 10 or more, as shown in FIG. 2, a uniform [W,Si]-oxide film of 5 μm or more is formed, and further high-temperature oxidation may be suppressed by preventing diffusion of Fe, Cr, Mn and O.

In addition, according to an embodiment of the present disclosure, the stainless steel may further include C: 0.001 to 0.01%, N: 0.001 to 0.01%, Nb: 0.3 to 0.6%, Mo: 0.3 to 2.5% and Cu: 0.2% or less. In addition, C+N may satisfy 0.018% or less.

The content of C is 0.001% to 0.01%.

Carbon is an element that greatly affects strength of steels. When the C content is excessive, strength of a steel is excessively increased to deteriorate ductility, and thus the C content is limited to 0.01% or less. However, when the C content is low, the strength is excessively lowered, so that a lower limit may be 0.001% or more.

The content of N is 0.001% to 0.01%.

Nitrogen is an element that accelerates recrystallization by precipitation of austenite during hot rolling. In the present disclosure, 0.001% or more of nitrogen is added. However, when the content is excessive, ductility of the steel is deteriorated, and the N content is limited to 0.01% or less.

C+N is 0.018% or less.

When C+N is too high, intergranular corrosion may occur due to formation of intergranular carbonitrides due to insufficient stabilization ratio. To prevent this, it is preferable to manage C+N to 0.018% or less.

The content of Nb is 0.3% to 0.6%.

Niobium is combined with dissolved C to precipitate NbC to lower the dissolved C content, increase corrosion resistance, and increase the high temperature strength. Therefore, in the present disclosure, the Nb content may be 0.3% or more. However, when the Nb content is excessive, the recrystallization is inhibited and the formability is lowered, the Nb content may be 0.6% or less.

The content of Mo is 0.3% to 2.5%.

Molybdenum plays a role of increasing corrosion resistance of ferritic stainless steels, improving high temperature strength and increasing high temperature sound absorption. Therefore, the Mo content may be 0.3% or more. However, when the content is excessive, brittleness occurs due to generation of intermetallic precipitates. Therefore, the Mo content may be 2.5% or less.

The content of Cu is 0.2% or less.

Copper has the effect of increasing corrosion resistance in an exhaust system condensate environment. Therefore, the Cu content may be 0.01% or more. However, when the content is excessive, ductility is lowered and quality of a molded product is lowered. Therefore, the Cu content may be 0.2% or less.

According to an embodiment of the present disclosure, the inevitable impurities may include any one or more of P: 0.05% or less, S: 0.005% or less, Mg: 0.0002 to 0.001%, and Ca: 0.0004 to 0.002%.

The content of P is 0.05% or less.

Phosphorus is an impurity that is inevitably contained in steels causing intergranular corrosion at the time of pickling or deteriorating hot workability. Therefore, the P content may be as low as possible. In the present disclosure, an upper limit of the P content is controlled to 0.05%.

The content of S is 0.005% or less.

Since sulfur is an impurity inevitably contained in the steel segregated in grain boundaries and mainly hindering hot workability. Therefore, the S content may be as low as possible. In the present disclosure, an upper limit of the S content is controlled to 0.005%.

The content of Mg is 0.0002 to 0.001%.

Magnesium is an element introduced for deoxidation in the steelmaking process and remains as an impurity after the deoxidation process. However, when the content is excessive, the moldability is inferior, so the content is limited to 0.001% or less, and since it is impossible to completely remove it, it is preferable to manage it to 0.0002% or more.

The content of Ca is 0.0004 to 0.002%.

Calcium is an element introduced for deoxidation in the steelmaking process and remains as an impurity after the deoxidation process. However, when the content is excessive, the corrosion resistance is inferior, so the content is limited to 0.002% or less, and since it is impossible to completely remove it, it is preferable to manage it to 0.0004% or more.

Next, a manufacturing method of a ferritic stainless steel excellent in oxidation resistance at high temperature according to an embodiment of the present disclosure will be described.

The manufacturing method of ferritic stainless steel excellent in oxidation resistance at high temperature of the present disclosure may produce cold-rolled annealing material through a normal manufacturing process, and Includes aging the cold-rolled annealing material at 400 to 600° C. for 30 to 90 minutes.

For example, the slab including Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities and satisfying a W/(Ti+Al) value of 10 or more may be produced as a cold rolled annealing material by hot rolling, hot rolling annealing, cold rolling and cold rolling annealing.

In addition, C, N, Nb, Mo, and Cu in the above-described range may be further included, and P, S, Mg, and Ca may be included as impurities.

By satisfying the above equation (1), and aging the cold rolled annealing material containing Nb, Mo, it is possible to precipitate Laves phase precipitate in the stainless steel structure. Laves Phase precipitate, which may be expressed as $[Fe,Cr]_2[W,Nb,Mo]$, may be precipitated from 0.01 to 1.0% by weight in the stainless steel structure by aging treatment. In order to precipitate the amount of precipitation in the above range, the relationship between the aging treatment temperature and time may be adjusted, and it may be preferably performed at 400 to 600° C. for 30 to 90 minutes.

When the Laves Phase precipitate containing W is excessively precipitated by more than 1.0% by weight, the amount of precipitation of the Laves phase precipitate containing W should be limited to 1.0% by weight or less because the high temperature strength decreases and the risk of brittle fracture increases due to the decrease of the dissolved W, Nb, and Mo.

The W Laves phase precipitate may include any one or more selected from a group consisting of $Fe_2W$, FeCrW, $Cr_2W$, the Nb Laves phase precipitate may include any one or more selected from a group consisting of $Fe_2Nb$, FeCrNb, $Cr_2Nb$ and the Mo Laves phase precipitate may include any one or more selected from a group consisting of $Fe_2Mo$, FeCrMo, $Cr_2Mo$.

Based on 100% by weight of the precipitated Laves Phase precipitate ($[Fe,Cr]_2[W,Nb,Mo]$), W should be included at 5% by weight or more. This is because when the Laves phase precipitate containing W is present in the surface layer of stainless steel, it plays a role as a seed for generating a [W, Si]-oxide film when exposed for 200 hours or more at 900° C. or higher. After exposure for 200 hours or more at 900° C. or higher, the [W, Si]-oxide film is uniformly formed, which may reduce the amount of high-temperature oxidation by 20% or more, and the high-temperature strength (TS) value of 900° C. may represent 40 MPa or more.

Hereinafter, it will be described in more detail through a preferred embodiment of the present disclosure.

Example

Using a stainless steel lab scale melting and ingot production facility, a 20 mm bar sample was prepared with the alloy component shown in Table 1 below. After reheating at 1200° C. and hot rolling to 6 mm, hot rolling annealing was performed at 1100° C., and after cold rolling to 2.0 mm, annealing treatment was performed at 1100° C. In addition, the cold rolled annealing plate was aged at 500° C. for 1 hour to produce a final product.

TABLE 1

| | C | Si | Mn | Cr | Mo | Nb | W | Ti | Al | Cu | N | C + N |
|---|---|---|---|---|---|---|---|---|---|---|---|---|
| Inventive Steel 1 | 0.007 | 0.3 | 0.6 | 19.3 | 0.5 | 0.5 | 1.1 | 0.01 | 0.01 | 0.1 | 0.006 | 0.013 |
| Inventive Steel 2 | 0.005 | 0.4 | 0.6 | 18.7 | 0.5 | 0.5 | 0.8 | 0.01 | 0.01 | 0.1 | 0.007 | 0.012 |
| Inventive Steel 3 | 0.006 | 0.3 | 0.7 | 19.1 | 0.6 | 0.4 | 1.0 | 0.04 | 0.03 | 0.1 | 0.006 | 0.012 |
| Inventive Steel 4 | 0.006 | 0.3 | 0.7 | 19.5 | 0.5 | 0.5 | 0.6 | 0.02 | 0.01 | 0.1 | 0.006 | 0.012 |
| Comparative Steel 1 | 0.005 | 0.3 | 0.6 | 18.8 | 0.5 | 0.5 | 1.2 | 0.1 | 0.06 | 0.1 | 0.007 | 0.012 |
| Comparative Steel 2 | 0.008 | 0.4 | 0.6 | 19.5 | 0.6 | 0.5 | 1.3 | 0.2 | 0.1 | 0.1 | 0.006 | 0.014 |
| Comparative Steel 3 | 0.006 | 0.4 | 0.7 | 18.9 | 0.6 | 0.4 | 1.4 | 0.1 | 0.3 | 0.1 | 0.006 | 0.012 |
| Comparative Steel 4 | 0.006 | 0.4 | 0.9 | 19.1 | 0.5 | 0.5 | 2.7 | 0.1 | 0.07 | 0.1 | 0.007 | 0.013 |

The final product was cut to a size of 100 mm×100 mm and heat treated at 900° C. for 200 hours in a box furnace. The weight increase and decrease of the oxide film was evaluated by measuring the weight before and after the heat treatment. After heat treatment, the cross-section of the specimen was observed with Fe-SEM to evaluate the composition, structure, thickness of the oxide scale, and which is shown in FIG. 4. The high temperature strength was evaluated after raising the temperature to 900° C. in a tensile machine after processing the JIS-13B tensile sample.

TABLE 2

| | | 900° C. 200 hours isothermal oxidation | | | |
|---|---|---|---|---|---|
| | W/(Ti + Al) | uniform [W, Si]-Oxide thickness (μm) | non-uniform [Ti, Al]-Oxide generation | weight gain (mg/cm$^2$) | 900° C. high temperature strength (MPa) |
| Inventive Steel 1 | 55.0 | 15 | x | 2.9 | 45 |
| Inventive Steel 2 | 40.0 | 12 | x | 3.0 | 43 |
| Inventive Steel 3 | 14.3 | 6 | x | 3.2 | 47 |
| Inventive Steel 4 | 20.0 | 7 | x | 3.1 | 41 |
| Comparative Steel 1 | 7.5 | 0 | ○ | 4.0 | 46 |
| Comparative Steel 2 | 4.3 | 0 | ○ | 4.1 | 47 |
| Comparative Steel 3 | 3.5 | 0 | ○ | 4.3 | 45 |
| Comparative Steel 4 | 15.9 | — | — | — | — |

FIG. 3 is a graph illustrating the correlation of [W, Si]-Oxide thickness after 200 hours exposure at 900° C. according to W/(Ti+Al) value.

Referring to FIG. 3 together with Table 1 and Table 2, since the inventive steels 1 to 4 satisfy the range of the component of the present disclosure and W/(Ti+Al) value is 10 or more, it was found that a uniform [W,Si]-oxide film was formed with a thickness of 6 μm or more. Further, non-uniform Ti and Al oxide films ($TiO_2$, $Al_2O_3$) were not produced. On the other hand, although all of W in Comparative Examples 1 to 3 were sufficiently added, the content of Ti and/or Al were high, so that the W/(Ti+Al) value was less than 10, and as a result, a uniform [W,Si]-oxide film was not produced.

On the other hand, Comparative Steel 4 satisfies equation (1) according to the present disclosure with W: 2.7%, Ti: 0.1%, Al: 0.07%, but the content of W exceeds 2.5%, resulting in plate breakage during manufacture. This was confirmed as a problem of brittleness due to the formation of an intermetallic precipitate due to excessive W content, as described above. Therefore, it was found that the upper limit of the W content should be limited to 2.5% or less.

FIG. 4 is a Fe-SEM photograph illustrating the oxidation scale composition of the cross-section of the inventive steel after 200 hours exposure at 900° C. Referring to FIG. 4, it is confirmed that an oxide film is formed on the matrix, and that [W,Si]-oxide film is formed on the matrix through the distribution of O, W, and Si.

FIG. 5 is a graph illustrating the correlation between the [W,Si]-oxide thickness formed after 200 hours exposure at 900° C. and the weight gain due to oxidation. Referring to FIG. 5 together with Table 1 and Table 2, when the uniform [W,Si]-oxide film of 5 μm or more is formed through the weight gain, it was found that the diffusion of Fe, Cr, Mn, and O was inhibited to suppress further high-temperature oxidation.

While the present disclosure has been particularly described with reference to exemplary embodiments, it should be understood by those of skilled in the art that various changes in form and details may be made without departing from the spirit and scope of the present disclosure.

INDUSTRIAL APPLICABILITY

The ferritic stainless steel according to the present disclosure can be expected to suppress high temperature oxidation and increase durability at high temperatures by forming a uniform oxide layer in an environment where a high temperature exhaust system is used.

The invention claimed is:

1. A ferritic stainless steel excellent in oxidation resistance at high temperature, the ferritic stainless steel comprising, in percent (%) by weight of the entire composition, Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities, wherein, when the ferritic stainless steel is exposed for 200 hours or more at 900° C. or higher, a [W,Si]-oxide film is formed on a surface layer, and wherein the ferritic stainless steel satisfies a following equation (1)

$$W/(Ti+Al) \geq 10 \quad (1)$$

(W, Ti, Al mean the content (% by weight) of each element).

2. The ferritic stainless steel of claim 1, wherein a thickness of the [W, Si]-oxide film is 5 μm or more.

3. The ferritic stainless steel of claim 1, wherein the stainless steel comprises 0.01 to 1.0% by weight of W Laves phase precipitate.

4. The ferritic stainless steel of claim 3, wherein the W Laves phase precipitate comprises any one or more selected from a group consisting of $Fe_2W$, FeCrW, $Cr_2W$.

5. The ferritic stainless steel of claim 1, wherein the stainless steel further comprises C: 0.001 to 0.01%, N: 0.001 to 0.01%, Nb: 0.3 to 0.6%, Mo: 0.3 to 2.5% and Cu: 0.2% or less, and satisfies C+N: 0.018% or less.

6. The ferritic stainless steel of claim 5, wherein the stainless steel comprises 0.01 to 1.0% by weight of W Laves phase precipitate, Nb Laves phase precipitate and Mo Laves phase precipitate, and comprises 5% or more by weight of W based on 100% by weight of all Laves phase precipitates.

7. The ferritic stainless steel of claim 6, wherein the Nb Laves phase precipitate comprises any one or more selected from a group consisting of $Fe_2Nb$, FeCrNb, $Cr_2Nb$.

8. The ferritic stainless steel of claim 6, wherein the Mo Laves phase precipitate comprises any one or more selected from a group consisting of $Fe_2Mo$, FeCrMo, $Cr_2Mo$.

9. The ferritic stainless steel of claim 6, wherein the W Laves phase precipitate comprises any one or more selected from a group consisting of $Fe_2W$, FeCrW, $Cr_2W$.

10. The ferritic stainless steel of claim 1, wherein the inevitable impurities comprise any one or more of P: 0.05% or less, S: 0.005% or less, Mg: 0.0002 to 0.001%, and Ca: 0.0004 to 0.002%.

11. A manufacturing method of a ferritic stainless steel excellent in oxidation resistance at high temperature, the manufacturing method comprising:

aging a cold rolled annealing material comprising, in percent (%) by weight of the entire composition, Cr: 10 to 30%, Si: 0.2 to 1.0%, Mn: 0.1 to 2.0%, W: 0.3 to 2.5%, Ti: 0.001 to 0.15%, Al: 0.001 to 0.1%, the remainder of iron (Fe) and other inevitable impurities, and satisfying a following equation (1)

$$W/(Ti+Al) \geq 10 \quad (1)$$

(W, Ti, Al mean the content (% by weight) of each element), wherein the aging is performed at 400 to 600° C. for 30 to 90 minutes.

12. The manufacturing method of claim 11, wherein the cold rolled annealing material further comprises C: 0.001 to 0.01%, N: 0.001 to 0.01%, Nb: 0.3 to 0.6%, Mo: 0.3 to 2.5% and Cu: 0.2% or less, and satisfies C+N: 0.018% or less.

* * * * *